United States Patent [19]

Abele

[11] Patent Number: 4,505,201

[45] Date of Patent: Mar. 19, 1985

[54] IMPACT RESISTANT BAG WITH INCREASED CIRCUMFERENTIAL YARN STRENGTH

[75] Inventor: Wolfgang P. Abele, Stuttgart, Fed. Rep. of Germany

[73] Assignee: Exxon Research & Engineering Co., Florham Park, N.J.

[21] Appl. No.: 572,730

[22] Filed: Jan. 19, 1984

[51] Int. Cl.[3] ..... F42B 3/00

[52] U.S. Cl. ..... 102/324; 102/282; 102/331; 139/389

[58] Field of Search ..... 102/323, 324, 331, 282; 139/389

[56] References Cited

U.S. PATENT DOCUMENTS

| | | | |
|---|---|---|---|
| 2,969,101 | 1/1961 | White | 102/324 X |
| 3,881,417 | 5/1975 | Mesia | 102/331 |
| 4,205,611 | 6/1980 | Slawinski | 102/324 |
| 4,369,711 | 1/1983 | Leader | 102/324 |

*Primary Examiner*—Peter A. Nelson

*Attorney, Agent, or Firm*—Robert L. Graham

[57] ABSTRACT

An impact resistant bag structure is made of a continuously woven fabric wherein the circumferential yarns and longitudinal yarns have a toughness ratio of between about 4.0/1.0 and 1.67/1.0. The bag structure is particularly useful in explosive bag applications.

15 Claims, 3 Drawing Figures

IMPACT RESISTANT BAG WITH INCREASED CIRCUMFERENTIAL YARN STRENGTH

BACKGROUND OF THE INVENTION

1. Field of the Invention

This invention relates to woven bags and similar containers designed for granular and liquid substances. In one aspect this invention relates to impact resistant bags made of a woven plastic fabric. In another aspect it relates to a bag for containing explosives for use in boreholes.

2. Description of the Prior Art

Explosive bags for use in deep boreholes such as those employed in mining operations must be designed to withstand dynamic impacts. In certain types of mining operations such as coal strip mining, bags containing explosives are dropped, one at a time, in a borehole. The explosive bags are collected at the bottom of the borehole and ignited. These bags must be designed to withstand free-fall impact on the water level in the borehole or the bottom of the borehole (if dry). Premature rupture of the bag during placement in the borehole results in deficient and frequently ineffective utilization of the explosives. In boreholes containing water, impact rupture at the water level causes the viscous emulsion explosive to bridge thereby preventing passage of subsequent explosive bags. Moreover, certain explosives such as ammonium nitrate are water sensitive and are rendered inoperative if the bag ruptures or leaks prior to ignition.

The problem of premature explosive bag rupture was addressed in U.S. Pat. No. 4,369,711 and the solution proposed therein involved the use of reinforcing sleeves on the lower portion of a woven bag.

U.S. Pat. No. 4,205,611 discloses an explosive bag which comprises a laminated structure of an internal waterproof liner, an external woven support, and an intermediate oil barrier film.

Although both of these patents disclose the use of woven fabric in explosive bags, neither distinguishes between the requirements of the circumferential yarns and the longitudinal yarns in such woven fabrics. As a result, use of the woven fabrics in accordance with prior art bag structures is less than optimum, since, as will be demonstrated below, the longitudinal yarns are overly designed for the explosive bag application.

SUMMARY OF THE INVENTION

As a result of theoretical studies and laboratory experiments, it has been discovered that the toughness requirements (for impact resistance) between circumferential yarns and the longitudinal yarns in woven bags differ significantly. By designing the woven bag on the basis of the critical dimension, the toughness and hence the amount of material for the noncritical dimension can be substantially reduced. This results in the optimum design permitting the savings of substantial material costs. Tests have shown that the critical factor in impact resistant woven bags is the toughness of the circumferential yarn. The term "toughness" as used herein in connection with yarns is a function of elongation and tensile strength. Specifically, toughness is the area under the stress-strain curve for yarns stressed to failure.

Because of the nonisotropic effect of the liquids (or materials that behave like liquids) in longitudinal containers when subjected to impact, the radial forces are substantially higher than the longitudinal forces. Theoretically, the maximum impact stress in the circumferential direction of the bag is about twice the stress in the longitudinal direction. Thus, the circumferential yarns in the woven support member may be designed to withstand the anticipated shockwave stress and the longitudinal yarns may be approximately 50 percent of the impact resistance of the circumferential yarns. The impact resistance of filled bags is a function of the energy absorption property of the woven fabric used in the bag. Toughness of the woven yarsn is a measure of the energy absorption capabilities of the fabric. In practice, it is preferred that the toughness of the longitudinal yarns be between about 40 and about 60 percent of the toughness of the circumferential yarns. In certain applications, the toughness of the longitudinal yarns may be as low as 20% of that of the circumferential yarns.

In summary, the present invention contemplates a bag for containing liquids or particulates which comprises a tubular member made of a circular weave having a circumferential yarn of sufficient size and toughness to absorb hydraulic shock resulting from dropping the bag, and a longitudinal yarn having a toughness of between about 20 and about 60 percent (preferably 40–60) of that of the circumferential yarn.

The toughness ratio can be obtained in a variety of ways, but preferably by making the yarns with tensile strength ratios the same as the toughness. When used for containing explosive material, the bag structure will include an inner waterproof liner and outer circular continuous woven fabric. The inner liner contains the explosives and fits snugly inside the woven fabric which provides strength for the structure. The liner may be made of polyethylene film or other plastic which are substantially water impermeable and resistant to the explosives contained therein; and the woven fabric may be polypropylene or any other plastic film, yarn or ribbon capable of being woven continuously and having a tensile strength of about 100 pounds per inch of fabric, preferably 150 pounds per inch, as measured in the circumferential direction.

DESCRIPTION OF THE PREFERRED EMBODIMENTS

Although the present invention may be used in any application where bags or containers must withstand impacts occasioned by vertical drops, such as grain bags and intermediate bulk containers, it is particularly applicable as an explosive bag. Accordingly, the preferred embodiments with the present invention will be described with specific reference to the explosive bag application.

Figure 1:
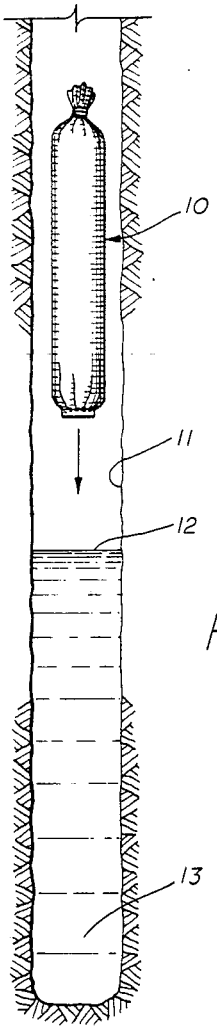
FIG. 1 is a cross-sectional view of a borehole containing an explosive bag constructed according to the present invention.

With reference to FIG. 1, an explosive bag 10 containing explosive material is shown descending in a borehole 11 of the type commonly used in coal strip mining operations. Frequently, such a borehole is partially filled with water, the surface of which is illustrated at 12. As mentioned above, the explosive bag 10 must withstand the shock of impact on the water surface and descend intact to the bottom of the borehole, 11. An additional requirement of an explosive bag is that it must be waterproof to prevent the intrusion of borehole water and also to contain liquids or powders within the bag.

Figure 2:
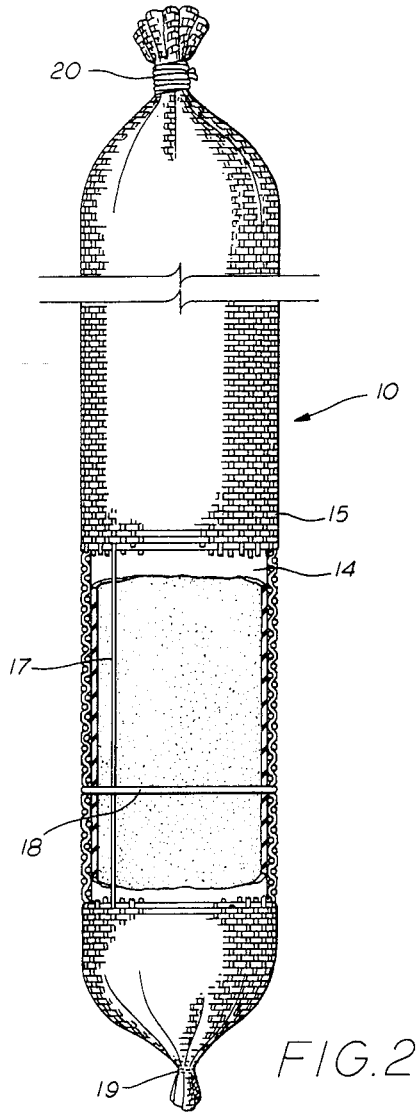
FIG. 2 is an enlarged side view of the explosive bag with portions cut away to disclose the inner liner of the explosive bag.

As best seen in FIG. 2 the bag 10 of the present invention comprises an inner plastic liner 14 and an outer woven support fabric 15.

The inner liner 14 serves to contain the particulate or liquid explosives and act as a barrier from external fluids, and the outer woven fabric 15 provides the strength to provide the proper dimensions of the bag to permit it to pass through the borehole to withstand the impact stresses described above.

The inner liner 14 may be made of any flexible, watertight material. The preferred materials include films of homopolymers and copolymers of alpha-olefins and blends of such homopolymers and copolymers such as polyethylene and polypropylene. A preferred film is polyethylene and/or blends of polyethylene and ethylene copolymers such as EVA. Polyethylene includes conventional LDPE, HDPE, MDPE, copolymers of ethylene and alpha-olefins, (LLDPE), EVA copolymers, and blends of these. These polymers can be processed by film casting and blowing equipment to produce liners of the proper dimensions. In the blown film process, the bubble of the proper diameter is maintained and upon collapsing a tubular film of proper diameter is obtained. By cutting the tubular film at the desired longitudinal intervals, and sealing one end thereof, the inner plastic liner 14 is formed. The inner liner 14 may have a wide range of thicknesses. For economics, it is preferred that a thin liner, in the order of 0.5 to 4.0 mils be used. Also, the size of the borehole dictates the diameter of the inner liner 14 and the outer tubular woven fabric 15. In most applications, the explosive bag will have an outside diameter of between 4 to 8 inches and a length of between 20 and 40 inches., with 5 inch diameter and 31.5 inches length being the typical dimensions of an ammonium nitrate explosive bag for mining operations.

The woven fabric 15 is also made in tubular form. Because of its uniform strength, it is preferred that the fabric be woven by the circumferential continuous weave process. In this process, the longitudinal yarns at the desired spacing (hereinafter referred to as longitudinal weave density, expressed as ends or picks per inch) are placed in the continuous weaving apparatus, such as a model 4/560 CIRCULAR WEAVING MACHINE manufactured by Lenzing USA Corporation of Austria, in parallel fixed relationship. The longitudinal yarns thus in combination define a cylinder having a diameter approximately that of the explosive bag. The fill yarns (hereinafter referred to as circumferential yarns) are woven through the longitudinal yarns in a continuous manner forming a tubular woven fabric. The fabric may be cut at the desired lengths and at one end thereof lapped over and stitched to provide a bottom closure. As illustrated in FIG. 2, the longitudinal yarns will run parallel to the axis of the bag 10 (one such yarn being indicated by 17) and the circumferential yarns will, in part, define the outer periphery of the bag 10 (one such yarn being indicated by 18). The bottom closure of the bag 10 may be stitched as at 19.

As previously indicated, and as discussed in more detail below, the toughness of the circumferential yarns 18 must be substantially greater than that of the longitudinal yarns 17. The ratio of the toughness of the circumferential yarns 18 to the longitudinal yarns 17 should be between about 4/1 and 1.67/1, preferably 2.5/1 and 1.67/1. (These ratios correspond to longitudinal yarn toughness of 20 to 60 percent, preferably 40 to 60 percent, of circumferential yarn toughness.) Ideally, of course, the toughness ratio should be 2 to 1, but because of variations in material, cross sections, and processing variables and because benefits may be derived at departures from the ideal, the invention contemplates the range as specified. (The values of toughness and tensile strength discussed herein represent those of the fabric and not individual yarns.) The toughness of the fabric in the circumferential direction should be designed to withstand free falls of at least 40 feet and preferably 80 and 100 feet.

The desired toughness ratio can be obtained by a variety of ways including making the yarns of different cross sectional area, processing the yarns differently (as by orientation), the addition of reinforcement materials in the circumferential yarns, or the use of entirely different materials. The preferred technique for achieving the proper toughness ratio is to simply select the circumferential yarns and longitudinal yarns on the basis of their tensile strengths to provide tensile strength ratios of the same magnitude cited above for toughness ratio (It is recognized that the tensile strength ratios may not precisely represent the same toughness ratios. However, tensile strength is easy to measure and when expressed as a ratio provides an approximate measurement of toughness ratio for purposes of this intention.

The tensile strength ratios of the yarns can be obtained by varying yarn denier and processing (e.g. orientation).

A variety of yarn materials may be used as the circumferential or longitudinal yarns. These include plastic materials such as polyolefins, nylon, polyesters, etc. The polyolefins are preferred and include ethylene and propylene homopolymers and copolymers. Specific polyolefins include polypropylene, LDPE, HDPE, MDPE, LLDPE and blends of these materials with one another or other polymers such as EVA. The preferred yarn is a polypropylene having a denier of between 200 and 6000 (preferably 1000–2000) for the circumferential yarn. This material may be used in a circumferential spacing (referred to as weave density) of between 4 and 25 picks per inch (typically 8.5 ppi) of fabric. If the longitudinal yarns are made of the same material, it will have a denier of between 100 to 3000 (preferably 500–1200), assuming the longitudinal weave density is the same.

The polypropylene yarn may be manufactured by the cast process wherein a film is cast and cooled by a water quench or chill roll and is thereafter slit to form the yarns of the desired width, followed by stretching, orientation, and heat set if desired. The yarns then are wound on separate spindles which are capable of use directly on the circular weaving equipment.

As is apparent from the above description, there are many variables available for obtaining the proper toughness ratio for the circumferential and longitudinal yarns. One convenient parameter is to select materials on the basis of tensile strength expressed in terms of pounds of force per linear inch necessary to cause the fabric to fail in the direction of the force. For the explosive bag application, it is preferred that the strength of the fabric in the circumferential direction be between about 100 and 600 pounds per inch (preferably 150–250 pounds per inch) and that strength of the fabric in the longitudinal direction be between about 50 and 300 pounds per inch (preferably 75–100 pounds per inch).

The strength of the fabric is based on testing in accordance with ASTM Test Procedures No. D1682.

In practice, the woven fabric 15 will house the internal plastic liner 14. The explosive material such as an emulsion of ammonium nitrate in oil is placed in the inner liner 14 and the top of the bag is closed as by a tie or clip 20. The explosive bag 10 containing explosive is dropped in the borehole 11 where it free falls to the water level 12 and then descends to the borehole bottom 13. The desired number of explosive bags 10 are collected in the borehole and detonated by conventional detonation means.

Experience with conventional explosive bags has indicated that when the bags failed on impact, the failure was almost always in circumferential yarns whereas the longitudinal yarns rarely failed. Moreover, it was observed that when the explosive bag contained a liquid or an emulsion explosives, the failure caused by impact was at two points or one of two points. In order to explain this phenomenon, theoretical calculations were made on an explosive bag having a diameter of 5 inch and a length of 31.5 inches. The bag was made of polypropylene woven fabric and contained an internal tubular polyethylene/EVA liner. The weight of the filled bag was calculated to be approximately 30 pounds (emulsion has a specific gravity of 1.3). The calculations were based on dropping the bag through a 120 foot borehole having a diameter between 6 and 7 inches. Under ideal conditions with aerodynamic drag, the bag required 2.74 seconds and attained a velocity of 87.68 feet per second, to reach the bottom of the borehole (dry). This produces a dynamic turbulent impact of 115,369.4 foot-pounds.

Figure 3:
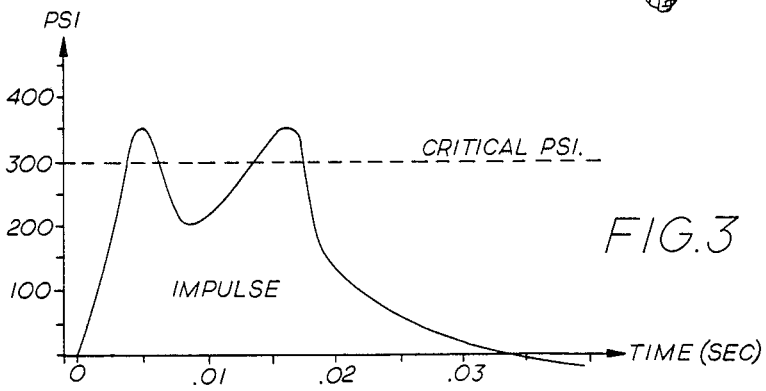
FIG. 3 is a plot illustrating the maximum impulses as a function of time following impact for liquids in containers.

Upon impact, a turbulent condition arises within the emulsion which is assumed to behave as a noncompressible fluid. The initial impact of the bottom of the bag causes the tubular bag to buckle in accordance with Euler column compression formulas using a fixity of 1. The total impact time span is calculated to be 0.0298 seconds. The impact generates a hydraulic impulse opposite in direction to the falling bag. This impulse clashes with the downward momentum of the emulsion within the bag. The hydraulic collision occurs simultaneously with buckling of the bag. To relieve the tremendous pressure increase the bag expands circumferentially at a location about 6 inches above the point of contact. If this expansion exceeds the strength of the circumferential yarns, the bag will fail. This initial rupture point, however, is only the temporary pressure relief. As the bag continues to buckle, a second pressure buildup occurs which is relieved by expansion of the cylinder at a point about 18 inches above the impact point. Here again, relief of this pressure occurs on failure of the circumferential yarns. FIG. 3 illustrates the double peak pressure as a function of time following impact. It is interesting to note that the peak pressure occurs at approximately the mid-point between the location of the first peak and the upper level of the emulsion in the container. The mechanical stress distribution of pressurized cylinders is such that circumferential stress is developed at twice the level of the longitudinal stress.

This theoretical analysis of the problem has led to the present invention which results in the saving of material. For example, if a woven fabric having the same circumferential and longitudinal yarns were used, the longitudinal yarns would be overdesigned in terms of toughness and strength. However, by using the circumferential yarns as the critical design parameter, the longitudinal yarns can be reduced in toughness and strength with the results that a much more economical bag can be manufactured and still not sacrifice performance.

An alternate embodiment of the invention is to employ a double layer of the woven fabric in the explosive bag. It has been found that the double layer of fabric more than doubles the strength of both the longitudinal and circumferential yarns. Thus, by using the double layer in the present invention, the yarn denier and/or weave density can be reduced which improves the economics of the explosive bag. The double layer tube may be manufactured by use of a continuous weaving apparatus to form a single layer woven tube. The tube can be cut at the desired longitudinal spacing and one section pulled over the other to provide the double layer for containing the internal liner. Alternatively, the woven tube can be extended double its desired length and by pulling the tube over itself, a double layered fabric of the desired length is obtained. The following experiments demonstrate the synergistic effect of the double layer fabric on tensile strength in comparison to two single layer fabrics. Laboratory tests were conducted on a continuously woven fabric having the following dimensions using ASTM Test Method No. D1682:

| | |
|---|---|
| Length | 8" |
| Width | 4" |
| Circumferential yarns (mils) | 3.4 × 105 (ribbon) |
| Denier | 1620 |
| Weave Density | 8.3 ppi |
| Longitudinal yarns (mils) | 2 × 100 (ribbon) |
| Denier | 1000 |
| Weave Density | 10 ppi |
| Material | Slit Film Polypropylene |

One set of tests was conducted on separate single layers of woven fabric to determine fabric tensile strength in the longitudinal and circumferential directions. A second set of tests was conducted on double layers of the fabric to determine fabric tensile strength again in both directions.

The force (pounds/inch of fabric) required to cause the yarns to fail was recorded.

| | Strength of Single Layer (Lbs/Inch) | Strength of Double Layer (Lbs/Inch) |
|---|---|---|
| Longitudinal | 98 | 217 |
| Circumferential | 140 | 290 |

As can be seen, the actual strength of the double layer exceeded twice the strength of the single layer.

As indicated previously, the invention may also be applied in connection with intermediate bulk containers (IBF) and grain containers. Intermediate bulk containers are large containers used to hold various bulk materials such as grains, minerals, polymer pellets, etc. in loading, transporting and unloading these containers. They are frequently subjected to vertical drops which imposes shock on the materials contained therein. The present invention as described above increases the ability of the IBC's to withstand the shocks. Because of the different requirements for the IBC application, the fabric will typically be as follows:

Circumferential yarns-Denier range (same as for Explosive Bag)

Strength 300 lbs/in (−10%+25%)

Longitudinal yarns-Denier range (same as for Explosive Bag)

Strength 150 lbs/in (−10%+25%)

The IBC will also be of tubular construction having a circumference between 144° and 164" and a length of about 40–80".

The invention also has application in grain bags which like the IBC's are subject to rough handling and frequently required to withstand shock occasioned by vertical free falls.

The weave density of both the IBC and grain bags should be sufficiently fine to contain particulate and granular material of 200 mesh and coarser.

In addition to the above described applications, other applications will occur to those skilled in the art wherein the circumferential yarns must be designed to withstand greater shocks and the longitudinal yarns in the same woven fabric container.

I claim:

1. An impact resistant bag comprising a woven fabric having a plurality of longitudinal yarns; and a continuous circumferential yarn or yarns interwoven through said longitudinal yarns, the weave densities of said yarns being between 4 and 25 picks per inch; said circumferential and longitudinal yarns having a toughness ratio of between about 4.0/1.0 and about 1.67/1.0.

2. The bag as defined in claim 1 wherein the yarns are made of a polyolefin and the tensile strength ratio of the circumferential yarn and the longitudinal yarns is between about 4.0/1.0 and 1.67/1.0.

3. The bag as defined in claim 2 wherein the tensile strength ratio of the circumferential and longitudinal yarns is between 2.0/1.0 and 1.67/1.0.

4. The bag as defined in claim 3 wherein the yarns are ribbons of polypropylene and the cross sectional area of the longitudinal yarns is between about 40 to about 60 percent of the cross sectional area of the circumferential yarns.

5. The bag as defined in claim 4 wherein the weave densities of the yarns are sufficiently fine to contain particulates larger than 200 mesh.

6. An impact resistant explosive bag structure which comprises (a) a substantially waterproof internal liner for containing explosive material; and (b) an external continuous layer of woven fabric for imparting impact strength to the bag structure, said fabric including a plurality of longitudinal yarns and circumferential yarns continuously interwoven through said longitudinal yarns, said circumferential yarns being of such toughness to withstand impact after a free fall of a depth of at least 40 feet, and the longitudinal yarns having a toughness of between 20 and 60 percent of that of the circumferential yarns.

7. The explosive bag as defined in claim 6 wherein the toughness of the circumferential yarns is sufficient to withstand an impact of an 80 foot free fall and wherein the longitudinal yarns have a tensile strength of between 40 and 60 percent of that of the circumferential yarns.

8. The explosvie bag as defined in claim 6 wherein the woven fabric includes polyolefin circumferential and longitudinal yarns and the tensile strength of the longitudinal yarns is 40 to 60 percent of that of the circumferential yarns.

9. The explosive bag structure as defined in claim 7 wherein the structure further comprises an emulsion explosive material in said inner liner.

10. The explosive bag as defined in claim 6 wherein the inner liner is made of an polyolefin film and is adapted to contain a liquid or liquid like explosive material; and said continuously woven fabric includes longitudinal and circumferential yarns of an olefin having a denier range respectively of 100 to 3000 and 200 to 6000.

11. The explosive bag as defined in claim 6 wherein the inner liner is a polyethylene film, and said woven fabric is made of polypropylene longitudinal and circumferential yarns.

12. The explosive bag as defined in claim 6 wherein the circumferential yarns are selected to withstand a free fall of at least 100 feet and the longitudinal yarns have a toughness of between 40 and 60 percent of that of the circumferential yarns.

13. An explosive bag as defined in claim 6 wherein the weave densities of the circumferential and the longitudinal yarns is between 4 to 25 picks per inch.

14. An explosive bas as defined in claim 6 wherein the woven fabric comprises a double layer.

15. An impact resistant bag comprising two continuously woven layers arranged concentrically and in close spacial relationship, said weave densities of the layers being sufficiently fine to contain granular material larger than 200 mesh, each layer containing longitudinal yarn continuously interwoven through said longitudinal yarns, with the tensile strength of the yarns of the combined layers in the longitudinal direction being from 40 to 60 percent of the tensile strength of the yarns of the combined layers in the circumferential direction.

* * * * *